United States Patent [19]

Gokhale

[11] Patent Number: 4,998,526

[45] Date of Patent: Mar. 12, 1991

[54] ALTERNATING CURRENT IGNITION SYSTEM

[75] Inventor: Kalyan P. Gokhale, Auburn Hills, Mich.

[73] Assignee: General Motors Corporation, Detroit, Mich.

[21] Appl. No.: 533,329

[22] Filed: Jun. 5, 1990

Related U.S. Application Data

[63] Continuation-in-part of Ser. No. 522,706, May 14, 1990, abandoned.

[51] Int. Cl.[5] ..... F02P 3/08

[52] U.S. Cl. ..... 123/598; 123/620; 123/621

[58] Field of Search ..... 123/596, 598, 605, 606, 123/620, 621, 622, 640, 643

[56] References Cited

U.S. PATENT DOCUMENTS

| | | | |
|---|---|---|---|
| 3,921,606 | 11/1975 | Habert | 123/620 X |
| 4,327,701 | 5/1982 | Gerry | 123/598 |
| 4,493,306 | 1/1985 | Asik | 123/620 |
| 4,562,823 | 1/1986 | Moritugu et al. | 123/620 |
| 4,677,960 | 7/1987 | Ward | 123/598 |
| 4,947,821 | 8/1990 | Somiya | 123/621 X |

*Primary Examiner*—Willis R. Wolfe

*Attorney, Agent, or Firm*—Creighton R. Meland

[57] ABSTRACT

An ignition system for a spark ignited internal combustion engine. The system can apply alternating current to the electrodes of a spark plug to maintain an arc at the electrodes for the desired length of time. The amplitude of the arc current can be varied. The alternating current is developed by a DC to AC inverter that is comprised of a transformer that has a center tapped primary and a secondary that is connected to the spark plug. An arc is initiated at the spark plug by discharging a capacitor through one of the winding portions of the center-tapped primary. Alternatively, the energy stored in an inductor can be supplied to a primary winding portion to initiate an arc. The ignition system is powered by a controlled current source that receives input power from a source of direct voltage such as a battery on a motor vehicle.

15 Claims, 5 Drawing Sheets

ALTERNATING CURRENT IGNITION SYSTEM

This application is a continuation-in-part of copending application Ser. No. 07/522,706 filed on May 14, 1990, now abandoned.

This invention relates to an ignition system for a spark ignited internal combustion engine and more particularly to an ignition system that develops an alternating current that is applied to a spark plug of the engine.

One of the objects of this invention is to provide an ignition system that delivers alternating current to the spark plug for any desired length of time and wherein the system includes arc initiation means that initiates the spark plug arc which is immediately followed by the delivery of alternating current to the spark plug to maintain the arc for any desired length of time. More specifically, an ignition system made in accordance with this invention utilizes a transformer that has a center tapped primary winding and a secondary winding that is connected to the spark plug. The system has a capacitor which is charged by a capacitor charging circuit that is powered from a low voltage direct voltage source such as the 12 volt battery on a motor vehicle. The charging circuit is a controlled current source and includes an inductor. To initiate an arc at the spark plug, the capacitor is discharged through one-half of the primary winding and thereafter the battery supplies current to the primary windings in opposite directions through switching means to cause an alternating current to be applied to the spark plug to the maintain arc that was initiated by discharge of the capacitor. The system separates the two basic tasks of an ignition system, namely, the initiation of the arc and the delivery of energy to maintain the established arc.

In accordance with another aspect of this invention the transformer, instead of having a center-tapped primary winding, has a single primary winding. The capacitor is discharged through the single primary winding and the secondary winding develops a voltage that is high enough to initiate a spark plug arc. Thereafter, the single primary winding is energized by a full bridge inverter powered by the battery to maintain the spark plug arc.

Another object of this invention is to provide an alternating current ignition system where the magnitude of arc current can be controlled as well as the duration of the arc.

In accordance with another aspect of the invention, the ignition system can be arranged such that it does not use a capacitor but rather uses the inductor of the controlled current source to initiate the spark plug arc. The inductive system does not perform as well as the system that uses the capacitor in regard to firing fouled spark plugs or where the engine is supplied with methanol fuels. The system that uses the discharge of a capacitor to initiate the spark plug arc is, accordingly, the preferred system.

IN THE DRAWINGS

Figure 1:
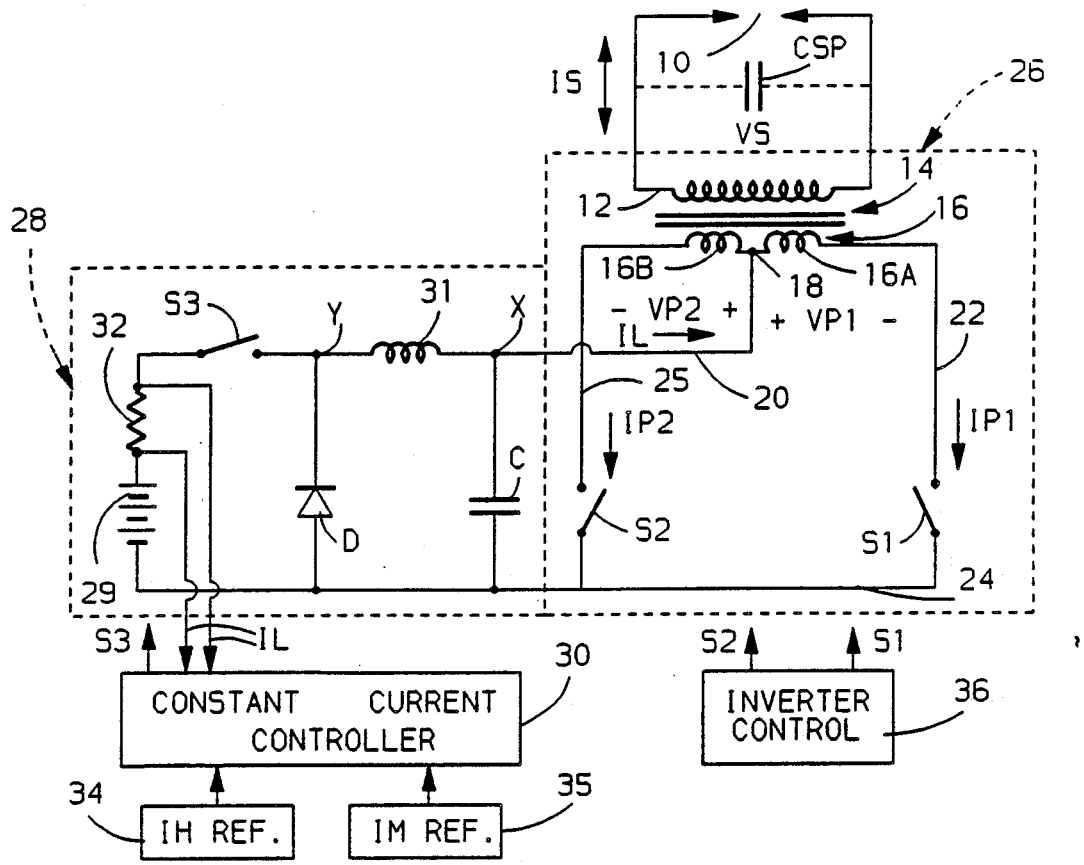
FIG. 1 is a circuit diagram of an alternating current ignition system, that utilizes a capacitor for spark plug arc initiation.
Figure 3:
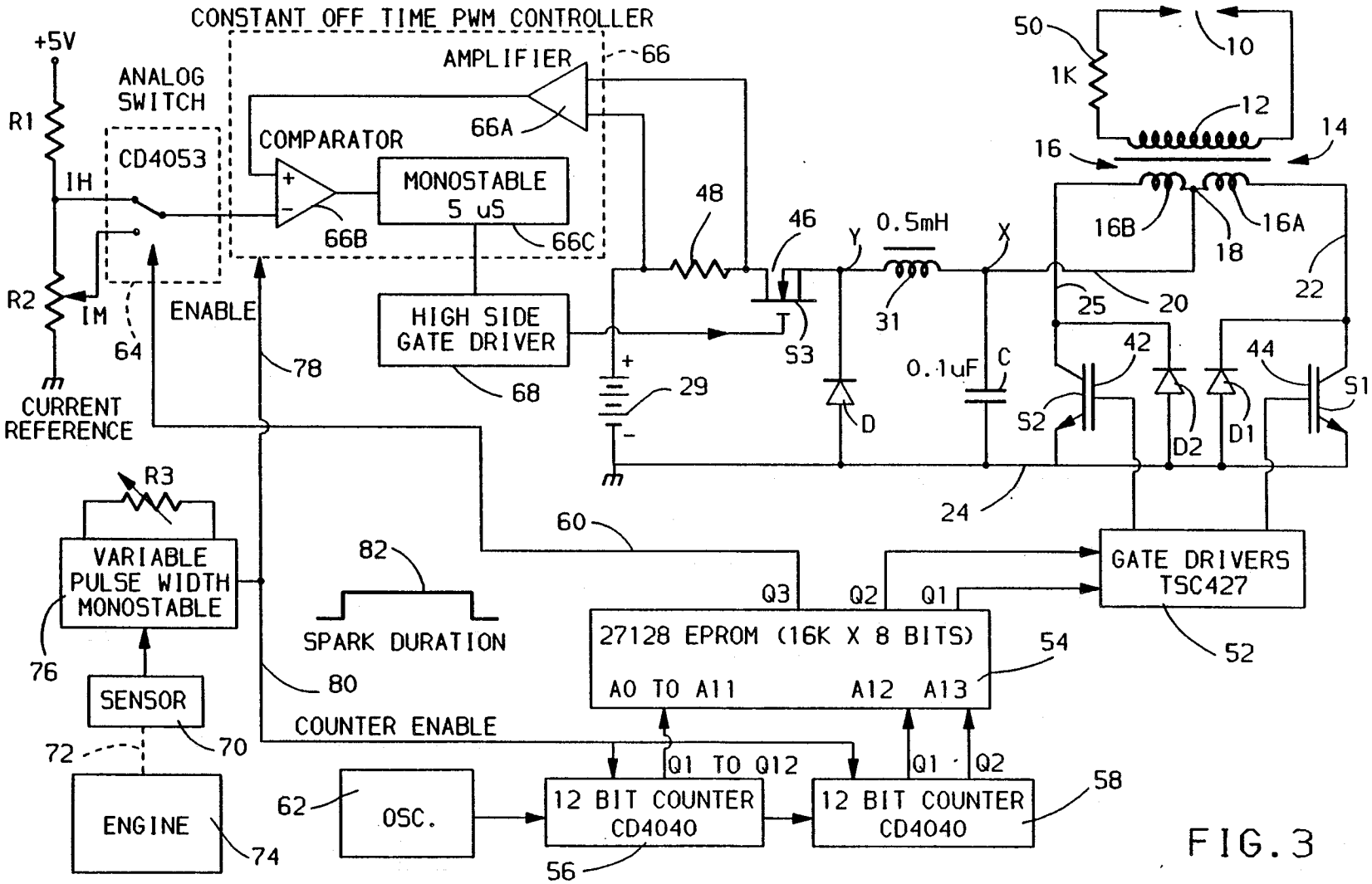
FIG. 3 is a circuit diagram similar to FIG. 1 but illustrating in greater detail preferred circuit components for an ignition system of the type shown in FIG. 1.

Referring now to FIG. 1, a generalized circuit diagram is illustrated of an alternating current ignition system that utilizes the discharge of a capacitor to initiate a spark plug arc. The circuit of FIG. 1 illustrates the general principles of this invention. The circuit of FIG. 3 shows specific components for implementing the circuit of FIG. 1.

The ignition system of FIG. 1 supplies a spark firing voltage to a spark plug 10 that is associated with the cylinder of a spark ignited internal combustion engine. The spark plug 10 is supplied with a spark firing voltage VS by the secondary winding 12 of a transformer 14, that is, opposite ends of the secondary winding are connected respectively to the electrodes of the spark plug. The transformer has a center-tapped primary winding 16 comprised of primary winding portions 16A and 16B that have an equal number of turns. The turns ratio N between a winding portion, for example, winding portion 16A and secondary winding 12 may be about 100; that is, there are about 100 turns on secondary 12 for each turn of primary winding portion 16A. The capacitance of spark plug 10 is denoted as CSP.

The center tap 18 of the primary winding is connected to a conductor 20. One side of winding portion 16A is connected to one side of switch S1 through line 22. The opposite side of switch S1 is connected to conductor 24. In a similar fashion, one side of primary winding portion 16B is connected to one side of switch S2 through line 25 and the opposite side of switch S2 is connected to conductor 24. The transformer 14 and switches S1 and S2 form a current source DC to AC inverter which has been designated as 26. The input to this inverter are lines 20 and 24 and this input is connected to a circuit 28 that is a controlled current source and capacitor charging circuit.

Circuit 28 is comprised of a direct voltage source 29 which is shown as a battery and which may be the 12 volt storage battery on a motor vehicle. The positive terminal of voltage source 29 is connected to one side of switch S3 and its negative terminal is connected to conductor 24. A capacitor C which may have a capacitance of about 0.1 microfarad is connected between node X on line 20 and line 24. A small inductor 31 of about 0.5 mH is connected between nodes Y and X. A diode D is connected between node Y and line 24.

The circuit of FIG. 1 has a constant current controller 30 which controls the opening and closing of switch S3 and which senses the current IL through inductor 31 by means of current sensing resistor 32. The sensed inductor current IL is compared to reference currents IH or IM provided respectively by circuits 34 and 35.

The circuit further has an inverter control circuit 36 that controls the on-off switching of switches S1 and S2.

The circuits 28 and 30 operate as a constant off time pulse-width-modulation (PWM) type current controller to maintain the inductor current IL approximately constant. The capacitor C is charged to a high voltage level of about 400 volts and is used to initiate the spark. Switches S1 and S2 alternately switch the inductor current IL between the two primary windings 16A and 16B of the center-tapped transformer 14 to produce an alternating spark plug current in the secondary winding 12.

The circuit of FIG. 1 separates the two basic tasks of any ignition system, namely, to initiate the spark plug arc and to deliver energy to the established arc. The capacitor C stores just enough energy to initiate an arc and once the arc is established, it plays no further part in the circuit operation. The arc is maintained for any length of time by continuously passing an alternating current to spark plug 10. The energy delivered to the arc comes directly from the battery 29 without any intermediate storage.

Figure 2:
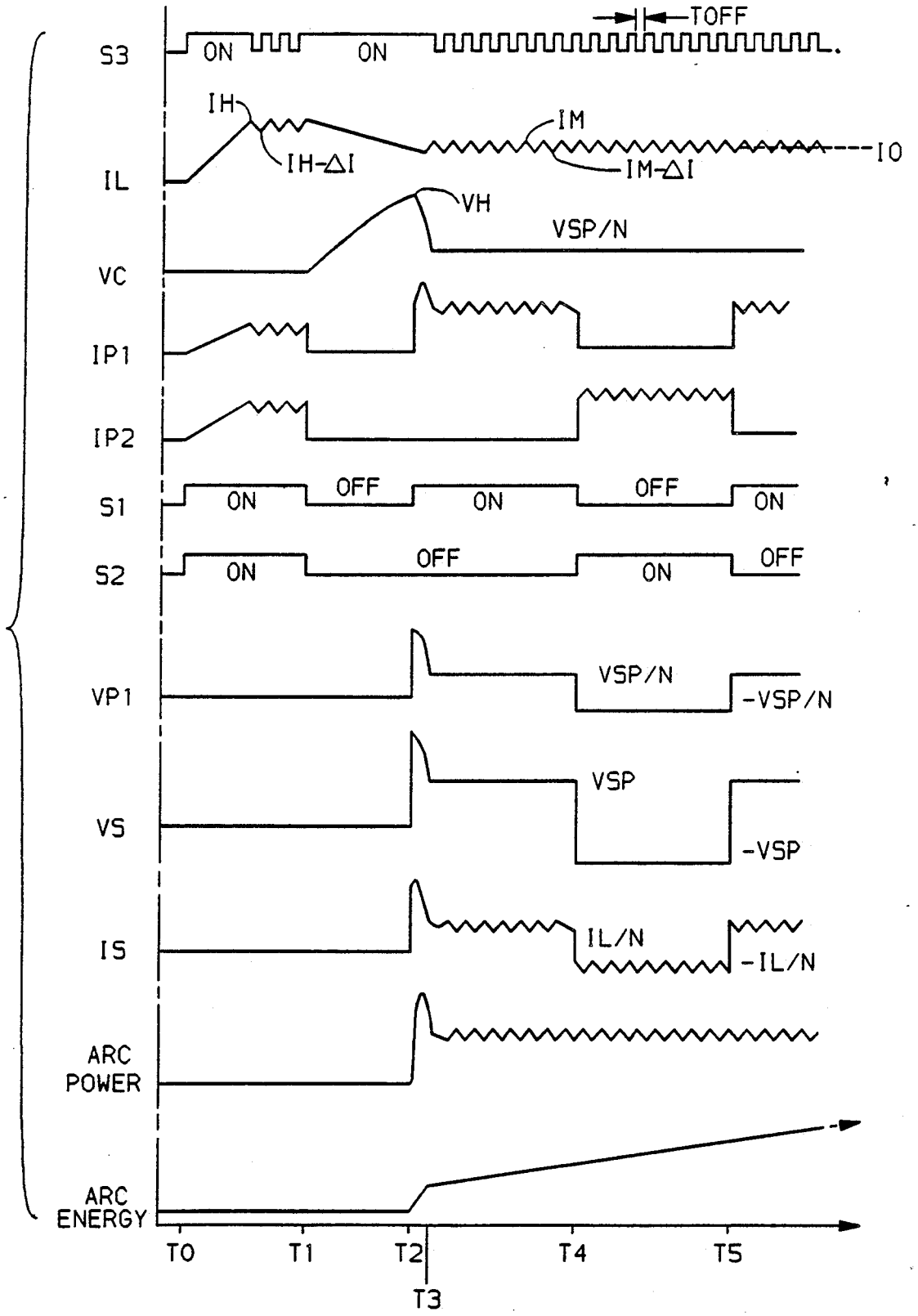
FIG. 2 illustrates waveforms that are related to the operation of the circuit shown in FIG. 1.

The operation of the FIG. 1 circuit will now be described with the aid of the waveforms shown in FIG. 2. The waveforms shown in FIG. 2 are plotted against elapsed time and some of the waveforms use symbols that are shown in FIG. 1. These waveforms are not to scale and are not intended to illustrate actual voltage, current or power values.

At time T0, all three switches S1, S2, and S3 are turned on. The inductor current IL splits equally into two primary winding currents IP1 and IP2 such that IP1=IP2=IL/2. The direction of the two primary currents IP1 and IP2 is such that the magnetic flux produced by one half of the primary cancels the flux produced by the other half and there is no net change of flux associated with the primary winding. This causes the voltage VP1 across 16A and the voltage VP2 across 16B equal to zero and therefore, the voltage across the entire primary 16, i.e. the voltage across 22 and 25 is also zero. Since both the switches S1 and S2 are on, the capacitor voltage VC (which is equal to voltage at node X) is also equal to zero. The inductor current IL rises with a slope of VB/L where VB is the voltage of source 29 and L is the inductance of inductor 31. Some time before time T1, the inductor current IL equals the reference value IH. Thereafter, the current controller 30 turns the switch S3 on or off, as needed, so that the inductor current IL remains between IH and (IH−ΔI). The operation of the current controller will be described in more detail later.

At time T1, the switches S1 and S2 are turned off. Since the magnetic flux in the inductor 31 can not change instantaneously, the current IL is forced through the capacitor C. The inductor 31 transfers some of its stored energy to the capacitor C. The inductor current IL decreases and the capacitor voltage VC at node X increases. At time T2, the capacitor voltage VC is equal to VH (400V) and the switch S1 is turned on to connect this charged capacitor across the primary winding 16A. The secondary voltage VS of secondary winding 12 rises extremely fast to a very large value because of the large turns ratio N of the transformer 14 and at time T3 an arc has been established at spark plug 10. The arc at spark plug 10 starts when the voltage VS exceeds the breakdown voltage of the spark plug which may be about 25 KV. During a very short period T2−T3, the capacitor voltage VC drops rapidly and the primary and secondary currents are of a pulsed nature.

At time T3, the capacitor is practically discharged and the inductor current IL flows through the primary winding 16A (IP1=IL) and because of the transformer action the secondary current IS, equal to IL/N, starts flowing through the arc and the secondary voltage falls to VSP. The voltage VSP is lower than the break down voltage of the spark plug and is a voltage that will maintain the spark plug arc, once the arc has been initiated by the higher secondary voltage VS caused by the discharge of capacitor C on the primary side. VSP may be about 800 volts.

At time T4, the switch S1 is turned off and simultaneously the switch S2 is turned on so that the inductor current IL now flows through the primary winding 16B (IP2=IL) in an opposite sense or opposite direction. Because of the transformer action the secondary (arc) current IS reverses its polarity (IS=−IL/N) and the secondary voltage is −VSP.

When the switch S1 is on, i.e. when the secondary voltage is VSP, the voltage at node X, VX, is VSP/N. Similarly, when the switch S2 is on, i.e. when the secondary voltage is −VSP, the voltage VX is also VSP/N.

At time T5, switch S1 is turned on again and S2 is turned off to establish a positive polarity arc current. This process is continued to produce an alternating spark current for any desired length of time. To terminate the arc, the battery supply is cutoff by turning the switch S3 off.

Further, in regard to the operation of controlled current source 28, the switch S3 is turned on and off, as needed, to maintain an approximately constant inductor current through inductor 31, equal to the reference currents IH or IM as the case may be. A reference circuit IH is used to charge the capacitor C while a reference current level IM is used to maintain the arc. When the current IL is less than the reference value IM, the switch S3 is turned on. The voltage across the inductor L is (VB−VX) and the current starts increasing with a slope of (VB−VX)/L. When the current reaches the level IM, the switch S3 is turned off for a fixed duration TOFF. The diode D turns on and the current IL freewheels through the diode D. The voltage across the inductor L is (−VX) and the current IL starts reducing at a rate of VX/L for a fixed duration of TOFF. Therefore, the drop in the inductor current is ΔI equal to (TOFF)*(VX)/L. This method of obtaining a controlled current source is called constant off time pulse width modulation. It can be appreciated that an average current IO is now being developed.

The arc at spark plug 10 represents an electrical load which consumes the electrical power to produce heat. The circuit continuously supplies the arc with an alternating current by switching the DC inductor current IL through the primary windings 16A and 16B using the switches S1 and S2. The inductor current is maintained at an average level of IO by connecting the battery voltage to the input side of the inductor L through the switch S3, as needed. While the arc is maintained, there is a continuous energy flow from the battery to the arc without any intermediate energy storage. Thus, while the arc is being maintained, there is a balance between the average power drawn from the battery and the power delivered to the arc. In order to achieve this power balance, the transformer turns ratio, N, is selected so that the condition VB>VX is met where VX=VSP/N.

Referring now to FIG. 3, an ignition circuit is shown that performs the same functions as the circuit of FIG. 1. In FIG. 3, the same reference numerals have been used as were used in FIG. 1 to identify corresponding circuit elements. FIG. 3 illustrates specific circuit components that perform the functions of the system shown in FIG. 1.

In FIG. 3, switches S2 and S1 take the form of N type insulated gate bipolar transistors 42 and 44 which may be type IXGH 20N100A transistors (IXYS Corp). Diodes D1 and D2 are respectively connected across transistors 44 and 42 with the anode of a diode connected to the emitter of a transistor and with the cathode of a diode connected to a collector of a transistor. These diodes are needed to protect transistors 44 and 42 from reverse current that is due to the leakage inductance and magnetizing inductance of transformer 14 of FIG. 3. Switch S3 is provided by a metal oxide field effect transistor 46 which may be a type SMP50N06 (Silconix Inc.). In FIG. 3 current inductor sensing is accomplished by means of a small resistor 48 that is connected in series with battery 29 and inductor 31. The voltage across resistor 48 is a function of inductor current IL. In FIG. 3, the spark plug 10 is connected to secondary 12 through a 1K ohm resistor 50 which serves as an EMI suppressor. The bases of transistors 42 and 44 are connected to a gate driver circuit which may be a Teledyne type TSC427 gate driver. Circuit 52 biases transistors 42 and 44 on and off in response to input signals to be described.

The on/off signals for transistors 42 and 44 are generated by a table look-up method by using an EPROM (Erasable Programmable Read Only Memory) 54 and counters 56 and 58. EPROM is a type 27128 EPROM (Intel) and counters 56 and 58 are each RCA CD4040 12 bit counters. Outputs Q2 and Q1 of EPROM 54 are connected to driver 52. Output Q3 is connected to a line 60. Counter 56 is connected to a square wave oscillator or clock pulse source 62 which has a frequency of 1 MHz. The pulse train developed by oscillator 62 is used as a timing clock. The two cascaded counters 56 and 58 form a 14 bit counter and count the clock pulses from source 62. The Q1 to Q12 outputs of counter 56 are connected respectively to the A0 to A11 inputs of EPROM 54. The Q1 and Q2 outputs of counter 58 are connected respectively to the A12 and A13 inputs of EPROM 54. As the counters count up, the EPROM's address increments and a set of outputs appear at the outputs Q1, Q2 and Q3 of the EPROM. The outputs Q1 and Q2 control on or off conditions of the transistors 42 and 44 respectively. The output Q3, which is applied to line 60, controls the SPDT (Single Pole Double Throw) analog switch 64. Switch 64 is an RCA type CD4053 analog switch. The counter increments every 1 μs, and accordingly every increment in the EPROM's address is a 1 μs increment in time.

The circuit of FIG. 3 has, a constant off time pulse width modulated controller 66 which is a Unitrode UC3846 controller. It is comprised of an amplifier 66A, a comparator 66B and a monostable multivibrator 66C. The multivibrator 66C, has an off-time of 5 microsecond duration. The output of multivibrator 66C is connected to a high side gate driver 68. Driver 68 is connected to the gate of field effect transistor 46. Driver 68 is an International Rectifier type IR2110 gate driver.

The fixed off time PWM control of the inductor current is achieved by using MOSFET 46 as the switch S3 and the PWM controller 66. The inductor current IL (IL is same as the MOSFET current when it is on) is measured as a voltage drop across a resistor 48. This voltage, representing the inductor current IL, is amplified and compared with a voltage representing a reference current. When the inductor current signal exceeds a reference value which is applied to a comparator 66B, the monostable 66C triggers and turns off the MOSFET 46 for a fixed duration of TOFF (=5 μs). High side gate driver 68 provides the necessary gate voltage required to turn on the MOSFET 46.

Two reference signals, IH and IM, are generated by a resistive potential divider R1 and R2 connected across 5 volt voltage source. The reference current level IM can be changed by adjusting the variable resistor R2. The analog switch 64 selects one of the two reference signals IM or IH under the control of a signal on line 60 from EPROM 54.

To provide proper spark timing, the system of FIG. 3 has a crankshaft position sensor 70 which is driven by the crankshaft 72 of an engine 74. The sensor 70 develops a signal when the piston of the engine is in a predetermined position where the spark plug 10 should be fired. The output of sensor 70 is connected to a variable pulse width monostable multivibrator 76. The pulse width can be adjusted by varying variable resistor R3.

The output of multivibrator 76 is connected to lines 78 and 80. This output is a square-wave 82 which has been labelled "spark duration" since the pulse-width of this square-wave corresponds to the time period that an arc is maintained across spark plug 10. The square-wave 82 is initiated when monostable 76 receives a timing signal from sensor 70. The square-wave 82 enables controller 66 and counters 56 and 58.

When the counters 56 and 58 are enabled, they are clocked by source 62 and the counters sequentially address EPROM 54 to sequentially change the output status of EPROM 54. The following table illustrates the sequence of events that occur as counters 56 and 58 are clocked:

| EPROM ADDRESS (time in μs) | Q1 (S1) | Q2 (S2) | Q3 | COMMENTS |
|---|---|---|---|---|
| 0 | 0 | 0 | 0 | All switches are off. |
| 1 | 1 | 1 | 0 | S1 and S2 are on and |
| 2 | 1 | 1 | 0 | the current reference |
| 3 | 1 | 1 | 0 | is set to IH. |
| . | . | . | . | |
| . | . | . | . | |
| . | . | . | . | |
| 1000 | 1 | 1 | 0 | |
| 1001 | 0 | 0 | 0 | S1 and S2 are turned off |
| 1002 | 0 | 0 | 0 | for charging of the |
| 1003 | 0 | 0 | 0 | capacitor C from the |
| 1004 | 0 | 0 | 0 | inductor current. |
| 1005 | 1 | 0 | 1 | S1 is turned on to |
| 1006 | 1 | 0 | 1 | connect the charged |
| 1007 | 1 | 0 | 1 | capacitor C across the |
| 1008 | 1 | 0 | 1 | primary winding 16A to |
| 1009 | 1 | 0 | 1 | initiate the arc. S1 |
| 1010 | 1 | 0 | 1 | will stay on for the ½ |
| 1011 | 1 | 0 | 1 | period (25 μs) to drive |
| 1012 | 1 | 0 | 1 | positive half of the arc |
| . | . | . | . | current. The current |
| . | . | . | . | reference is switched |
| . | . | . | . | from IH to IM. |
| 1029 | 1 | 0 | 1 | |
| 1030 | 0 | 1 | 1 | S1 is turned off and S2 |
| 1031 | 0 | 1 | 1 | is turned on. This con- |
| 1032 | 0 | 1 | 1 | dition will be in effect |
| 1033 | 0 | 1 | 1 | for the next 25 μs to |
| 1034 | 0 | 1 | 1 | pass negative half of |
| . | . | . | . | the arc current. No |
| . | . | . | . | change in the reference |
| . | . | . | . | current. |
| 1054 | 0 | 1 | 1 | |
| 1055 | 1 | 0 | 1 | S1 is turned on and S2 |
| 1056 | 1 | 0 | 1 | is turned off. This con- |
| 1057 | 1 | 0 | 1 | dition will be in effect |
| 1058 | 1 | 0 | 1 | for the next 25 μs. No |

-continued

| EPROM ADDRESS (time in μs) | Q1 (S1) | Q2 (S2) | Q3 | COMMENTS |
|---|---|---|---|---|
| | | | | change in the current reference. |

At time t=1 μs, that is one microsecond after the beginning of square-wave 82, the transistors 42 and 44 are turned on and the inductor current equal to IH is demanded from the PWM controller 66. Since the inductor current was previously zero, the PWM controller 66 turns the MOSFET 46 on. This condition is maintained for 1000 μs (1 ms) allowing sufficient time for the inductor current to rise from 0 to IH. In case the inductor current reaches the reference level IH early, the PWM current controller 66 keeps the inductor current within ΔI of IH by turning the MOSFET 46 on and off as needed.

At time t=1001 μs, the transistors 42 and 44 are turned off for 4 μs so that the inductor current can charge the capacitor C.

At time t=1005 μs, the transistor 44 is turned on to discharge the capacitor through primary winding 16A to initiate the arc. The transistor 44 remains on for the next 25 μs to drive a positive half cycle of the arc current. The reference to the current controller is now changed from IH to IM by the change of signal on line 60 from Q3.

At time T=1030 μs, it is a time for a negative half cycle of the arc current. The transistor 44 is turned off and transistor 42 is turned on for the next 25 μs duration. This process is continued until the variable pulse width monostable pulse 82 terminates. At the end of the pulse 82, the PWM controller 66 and the counters 56 and 58 are disabled, the two transistors 42 and 44 and the MOSFET 46 are turned off and the arc is terminated.

Figure 4:
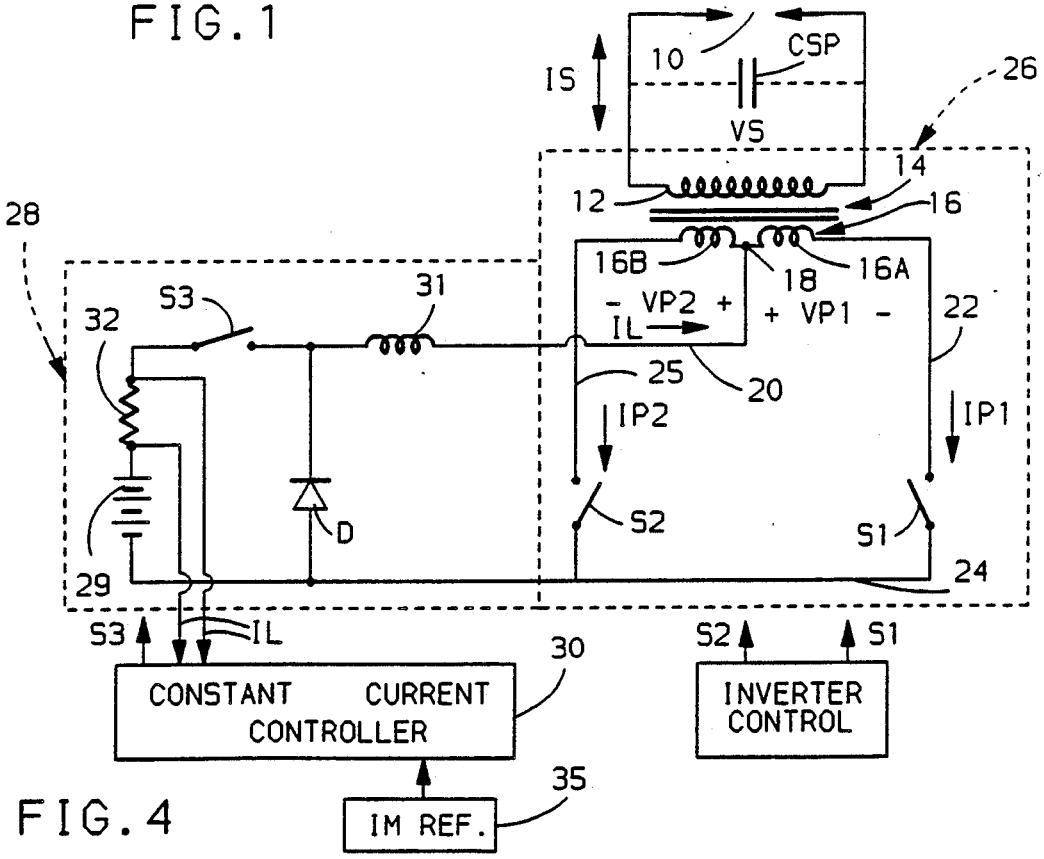
FIG. 4 illustrates a circuit diagram of an alternating current ignition system that utilizes an inductor for spark plug arc initiation.

FIG. 4 shows a modified alternating current ignition circuit that differs from the systems of FIGS. 1 and 3 in that the capacitor C is eliminated and the timing sequence of the switches S1 and S2 is modified. Further, the system of FIG. 4 uses only one current reference, namely current reference IM. The arc is initiated by energy stored in inductor 31 and it is maintained for a predetermined duration by passing an alternating current to spark plug 10.

Figure 5:
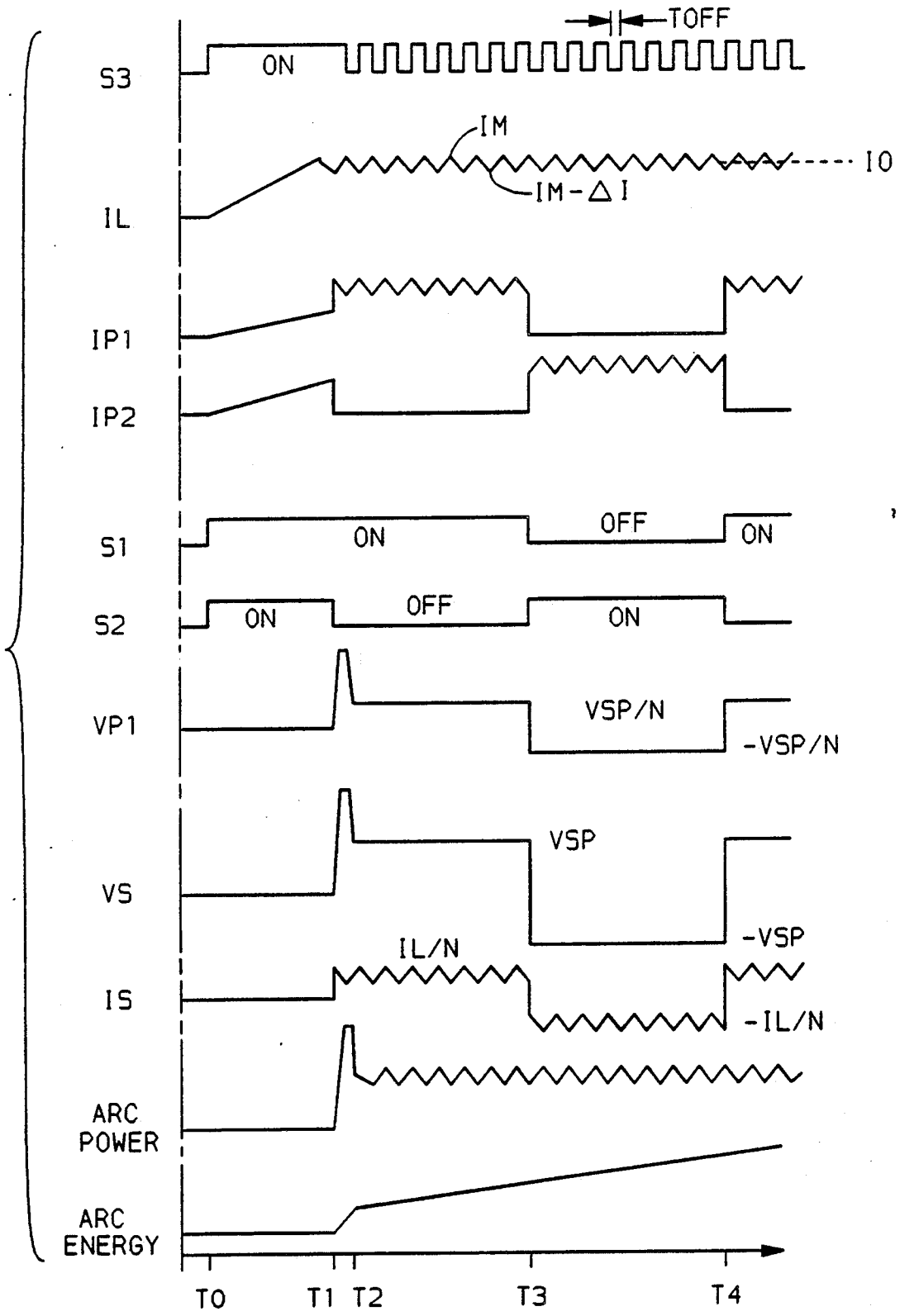
FIG. 5 illustrates waveforms that are related to the operation of the circuit shown in FIG. 4.

The operation of the circuit is described with the aid of FIGS. 4 and 5 where FIG. 5 illustrates waveforms associated with FIG. 4. At time T0, all three switches S1, S2 and S3 are turned on. The inductor current IL splits equally (IP1=IP2=IL/2) in the two primary windings 16A and 16B of the transformer. The direction of the two primary currents is such that the magnetic flux produced by each half of the primary cancels each other so that VP1=VP2=0. The inductor current rises with an initial slope of VB/L. At time T1, IL equals the reference value IM and the switch S2 is turned off. Since the magnetic flux in the inductor 31 can not change instantaneously, the current IL is forced through the primary winding 16A, which results into a secondary current IS equal to IL/N. This secondary current starts charging the spark plug capacitance CSP and the secondary voltage VS starts to increase very rapidly and at time T2, it equals the break down voltage of the spark plug and an arc is established across spark plug 10. Now, the secondary current IS starts flowing through the arc and the secondary voltage falls to VSP.

At time T3, the switch S1 is turned off and simultaneously the switch S2 is turned on so that the secondary (arc) current reverses its polarity and the secondary voltage is −VSP. At time T4, switch S1 is turned on again and S2 is turned off to establish positive polarity arc current. This process is continued to produce alternating spark current for any desired length of time. To terminate the arc, the battery supply is cutoff by turning the switch S3 off.

This circuit of FIG. 4 differs from the circuits of FIGS. 1 and 3 in the way an arc is established. Once the arc is established, the circuit operation and the energy and power relationships are identical to the circuit of FIGS. 1 and 3.

The circuit of FIG. 4 can be implemented in a manner shown in FIG. 3 by eliminating the capacitor C the current reference IH and appropriate change in the data stored in the EPROM to modify the switching sequence of S1 and S2.

Figure 6:
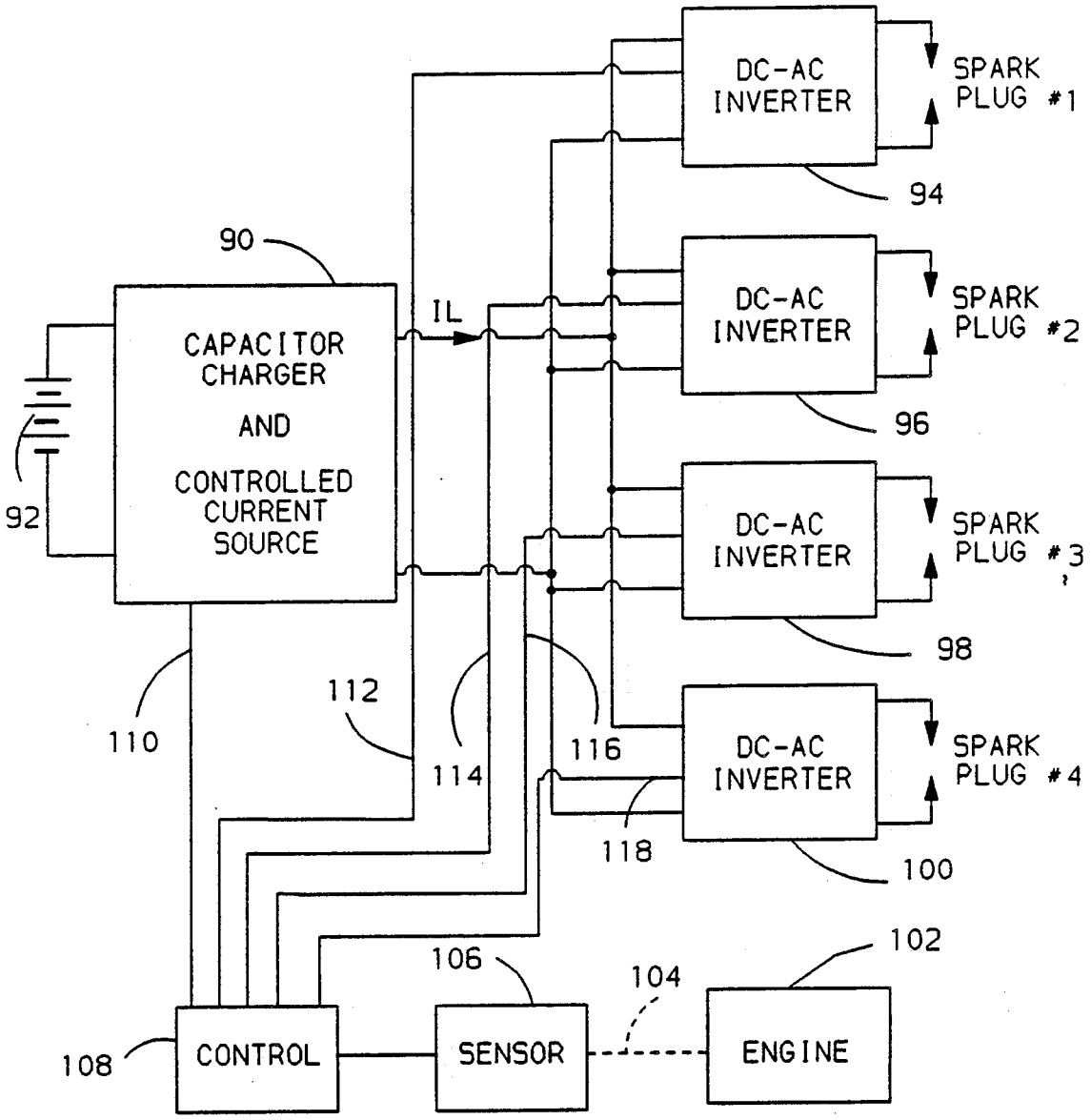
FIG. 6 illustrates an ignition system for a multi-cylinder internal combustion engine made in accordance with this invention.

This invention has, thus far, been described in connection with a single cylinder engine. FIG. 6 illustrates how this invention can be used for a multi-cylinder engine and specifically a four cylinder engine.

In FIG. 6, reference numeral 90 designates a capacitor charger and controlled current source powered by battery 92. Circuit 90 is of the type shown in FIGS. 1, 3 or 4. Circuit 90 feeds four DC to AC inverters, 94, 96, 98 and 100 which are respectively connected to a spark plug. Each inverter is of the type shown in FIGS. 1 or 3.

In FIG. 6, an engine 102 has a crankshaft 104 connected to a crankshaft position sensor 106. This sensor supplies electrical signals to an electronic control 108. Control 108, supplies a signal to line 110 which controls circuit 90 in the same manner as the output signal of sensor 70 in FIG. 3. Control 108 also develops sequential control signals on lines 112, 114, 116 and 118 for sequentially enabling the inverters 94, 96, 98 and 100 at predetermined crankshaft positions. Putting it another way, the signals on lines 112–118 are cylinder selector signals for selecting the proper cylinder to be fired. This is a so-called distributorless system. It should be appreciated, however, that the system of this invention could be used with a distributor that would sequentially connect the system to the spark plugs. Thus, the secondary 12 of FIGS. 1 and 3 could be connected to a distributor that would sequentially connect secondary 12 to a plurality of spark plugs.

The following summarizes various features of this invention:

1. The ignition system maintains a continuous arc by passing an alternating current to the spark plug for any desired length of time. The energy to the arc is delivered directly from the battery without any intermediate energy storage. The arc is supplied with a constant power equal to VSP*I0/N. In a circuit with VSP=800V, IO=10 Amps and N=100, the power was 80W. The energy delivered to arc over a 4 ms duration was 320 mJ (80W*4 ms=320 mJ), more than 10 times that of a conventional inductive system.

The magnitude of the arc current can easily be controlled by adjusting the reference current level to the current controller. The duration of the arc can also be controlled by adjusting the pulse width of the variable pulse width monostable 76. Such a programmable ignition system can provide a right kind of arc current-arc duration combination for an optimum engine performance at all engine operating conditions.

2. The CD (capacitor discharge) type of arc initiation (FIGS. 1 and 3) is preferable to the inductive type shown in FIG. 4. It performs much better with fouled plugs and with methanol fuels. The system shown in FIGS. 1 and 3 uses capacitor discharge type arc initiation with high arc currents, but of much shorter duration. Also, this high current pulse occurs at the beginning of the arc and only once per combustion event. In a multi-strike CD system, a high current pulse occurs every time an arc is striken. Thus, plug erosion with the system of this invention is expected to be less than a multi-strike system.

3. The inductor 31 serves two functions. It charges the capacitor C for a CD spark initiation and then serves as a current smoothing choke in a constant current controller. The size of the inductor 31 depends only upon the energy required to store enough charge on the capacitor C to initiate the arc and not on the total amount of energy delivered to the arc.

4. The system has a built-in arc restrike capability in case the arc is extinguished by turbulent air in an engine cylinder. As mentioned in the previous paragraph, after the arc initiation the inductor is serving as a current smoothing choke and still has some energy stored in it. If the arc fails, the inductor current charges the capacitor C to a high voltage level and when S1 or S2 are turned on, a high voltage is applied to the spark gap to re-establish the arc. In other words, upon failure of the arc, the circuit follows the steps taken during interval T1 to T3. The build-in restrike capability of the system can also be used to purposely turn the arc off and restrike the arc again after some suitable delay. To turn the arc off, the two switches S1 and S2 are turned on simultaneously. This causes a short circuit across the primary, the arc current goes to zero and the arc terminates. The situation is the same as during Time T0 to T1. The constant current controller maintains a constant current level IL through the inductor by PWM action of the switch S3. When the arc needs to be initiated, the switches S1 and S2 are controlled exactly the same manner as described in FIGS. 2 and 4 after Time T1.

5. The size of the capacitor C can be very small about 15% as compared with the conventional capacitor discharge systems because it stores just enough energy to initiate the arc and not the total amount of energy delivered to the arc.

6. The multi-strike CD or the dual action (inductive with a CD start) ignition systems have separate electronic (transformers, transistors etc.) circuits to charge a capacitor to a high voltage level. Also, a separate winding and a switch may be needed to discharge the capacitor to initiate the spark. In the circuit of this invention, a novel switching sequence of switches S1 and S2 during time period T0 to T3 is devised to first transfer the energy from the battery to the inductor 31 and then from inductor 31 to capacitor C. (No additional switch is required). Also, the same switch (S1 or S2) is used to discharge the capacitor C to initiate the arc.

7. A combination of a center-tapped primary winding and two switches S1 and S2 convert the DC inductor current IL into an alternating current. The choice of center-tapped primary winding has the advantage that only two switches are required to produce AC output from a DC input. The switches S1 and S2 transfer the energy from the battery to the inductor 31 by effectively short circuiting the two primary winding sections. Also, no additional winding is required to discharge the capacitor C to initiate the arc.

8. The transformer in the inverter section receives energy from the current source and delivers it to a plug without any energy storage. Thus, the size and cost of the transformer depends only upon its power level and the frequency of operation. With the availability of fast semiconductor switches and low loss ferrite transformer cores, the switching rate of S1 and S2 can be increased up to 20 kHz and beyond. The higher the operating frequency of the inverter, the smaller the size of the transformer and easier it is to mount the transformer on the plug for Coil-Near-Plug designs. In the system of FIG. 3, the size of the ferrite core transformer is about 1 in $^3$.

Figure 7:
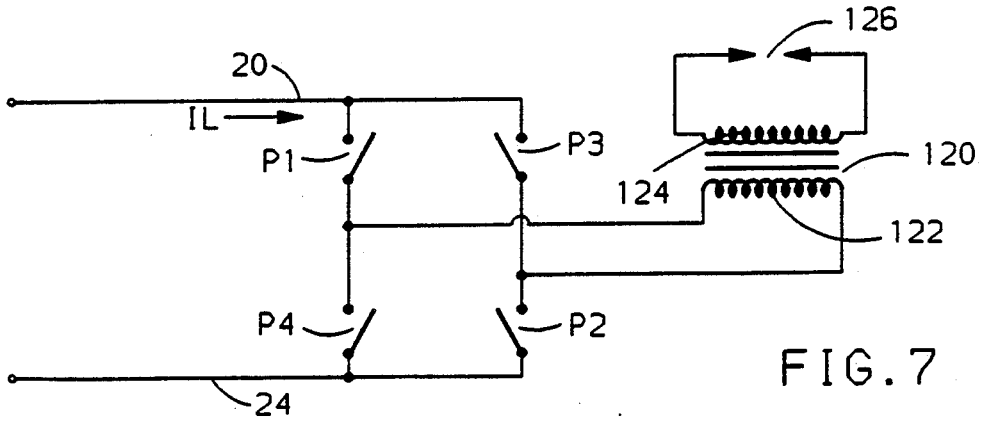
FIG. 7 illustrates a full bridge inverter that could be utilized in the ignition systems of this invention.

FIG. 7 illustrates an inverter that can be used instead of the inverter 26 shown in FIGS. 1 and 4. The inverter shown in FIG. 7 is a so-called full bridge DC-AC inverter and is comprised of switches P1, P2, P3 and P4. Instead of using a center-tapped primary winding, the system of FIG. 7 uses a transformer 120 having a single primary winding 122 and a secondary winding 124 that is connected to a spark plug 126. The operation of the circuits shown in FIGS. 1, 3 and 4 is unchanged except for the following modification. Switches P1 and P2 (together) take the place of the switch S1, while switches P3 and P4 (together) take the place of switch S2. In other words, when the switch S1 is called for to turn on or off, the switch pair P1 and P2 is turned on or off and similarly, when the switch S2 is called for to turn on or off, the switch pair P3 and P4 is turned on or off. The operation of the switch S3 in the current controller section remains unaffected.

The embodiments of the invention in which an exclusive property or privilege is claimed are defined as follows:

1. An ignition system for a spark ignited internal combustion engine comprising, a transformer having a primary winding means comprised of at least one primary winding and a secondary winding, means connecting said secondary winding to a spark plug, a source of direct voltage, a capacitor, means for charging said capacitor from said source of direct voltage, means for discharging said capacitor through said primary winding means to thereby cause a voltage to be developed in said secondary winding that is high enough to initiate an arc at the electrodes of said spark plug, and means operative after said arc has been initiated for causing an alternating current to be developed in said secondary winding that is applied to the electrodes of said spark plug from said secondary winding to maintain said arc, said last named means comprising means connecting said primary winding means sequentially to said source of direct voltage.

2. The ignition system according to claim 1 where said primary winding means is a center-tapped primary winding.

3. The ignition system according to claim 1 where said primary winding means is a single primary winding.

4. An ignition system for a spark ignited internal combustion engine comprising, a transformer having a center tapped primary winding defining a pair of primary winding portions and a secondary winding, means connecting said secondary winding to a spark plug, a source of direct voltage, a capacitor, means for charging said capacitor from said source of direct voltage, means for discharging said capacitor through one of said primary windings portion to thereby cause a voltage to be developed in said secondary winding that is high enough to initiate an arc at the electrodes of said spark plug, and means operative after said arc has been initiated for causing an alternating current to be developed in said secondary winding that is applied to the electrodes of said spark plug from said secondary winding to maintain said arc, said last named means comprising means connecting said primary winding portions sequentially to said source of direct voltage.

5. The ignition system according to claim 4 where means are provided for controlling the magnitude of the secondary current of said primary winding.

6. The ignition system according to claim 4 which includes means for controlling the duration of time that said alternating current is developed in said secondary winding.

7. An ignition system for a spark ignited internal combustion engine comprising, a DC to AC inverter that is comprised of a transformer having a center tapped primary winding and a secondary winding, said primary winding comprised of a pair of winding portions, means connecting said secondary winding to a spark plug, a source of direct voltage, a capacitor, means for charging said capacitor from said source of direct voltage, means for discharging said capacitor through one of said primary winding portions to thereby cause a voltage to be developed in said secondary winding that is high enough to initiate an arc at the electrodes of said spark plug, and means operative after said arc has been initiated for causing said inverter to be energized from said source of direct voltage and to operate such that an alternating current is developed in said secondary winding which is applied to the electrodes of said spark plug for maintaining an arc.

8. The ignition system according to claim 7 where means are provided to control the magnitude of the secondary current of said secondary winding.

9. The ignition system according to claim 7 where means are provided for controlling the duration of time that said alternating current is developed in said secondary winding.

10. The ignition system according to claim 7 that has a controlled current source that is energized from said source of direct voltage, said controlled current source comprising an inductor and switching means for connecting and disconnecting said inductor to and from said source of direct voltage, said controlled current source operative to charge said capacitor and operative to supply current to said inverter.

11. An ignition system for a spark ignited internal combustion engine comprising a DC to AC center tapped primary winding and a secondary winding, said primary winding comprised of a pair of winding portions, said inverter including first and second switching means connected respectively to said primary winding portions, means connecting said secondary winding to a spark plug, a source of direct voltage, a capacitor, circuit means for causing said capacitor to be charged from said source of direct voltage including means for causing said first and second switching means to both be in an open condition to charge said capacitor, a capacitor discharge circuit for discharging said capacitor through one of said primary winding portions including one of said first and second switching means, said capacitor discharging when said one of said first and second switching means is closed, the discharge of the capacitor through a primary winding portion causing a voltage to be developed in said secondary winding that is high enough to initiate an arc at the electrodes of said spark plug, and means operative after said arc has been initiated for causing said first and second switching means respectively to connect and disconnect said primary winding portions to and from said source of direct voltage such that an alternating current is developed in said secondary winding that is applied to the electrodes of said spark plug to maintain said arc.

12. An ignition system for a spark ignited internal combustion engine comprising, a DC to AC inverter that is comprised of a transformer having a center tapped winding and a secondary winding, said primary winding comprised of a pair of winding portions, said inverter including first and second switching means connected respectively to said primary winding portions, means connecting said secondary winding to a spark plug, a source of direct voltage, a current source control circuit energized by said source of direct voltage comprising a third switching means and an inductor, said third switching means connecting and disconnecting said inductor to and from said source of direct voltage, a capacitor, circuit means for causing said capacitor to be charged from said current source control circuit including means for causing said first and second switching means to both be in an open condition to charge said capacitor, a capacitor discharge circuit for discharging said capacitor through one of said primary winding portions including one of said first and second switching means, said capacitor discharging when said one of said first and second switching means is closed, the discharge of the capacitor through a primary winding portion causing a voltage to be developed in said secondary winding that is high enough to initiate an arc at the electrodes of said spark plug, and means operative after said arc has been initiated for causing said first and second switching means to connect and disconnect said primary winding portions to and from said current source control circuit such that an alternating current is developed in said secondary winding that is applied to the electrodes of said spark plug to maintain said arc.

13. The ignition system according to claim 12 where said current source control circuit includes a means for sensing the current through the inductor and for controlling the switching of said third switching means in response to sensed inductor current to maintain the inductor current at a predetermined value.

14. The ignition system according to claim 12 where means are provided for controlling the duration of time that alternating current is applied to said spark plug.

15. An ignition system for a spark ignited internal combustion engine comprising, a DC to AC inverter that is comprised of a transformer having a center tapped primary winding and a secondary winding, said primary winding comprised of a pair of winding portions, means connecting said secondary winding to a spark plug, a source of direct voltage, a current source control circuit comprising an inductor and a switching means for connecting and disconnecting said inductor to and from said source of direct voltage, means operative after said switching means has disconnected said inductor from said source of direct voltage for connecting said inductor to one of said primary winding portions to thereby cause a voltage to be developed in said secondary winding that is high enough to initiate an arc at the electrodes of said spark plug, and means operative after said arc has been initiated for causing said inverter to be energized from said current source control circuit and to operate such that an alternating current is developed in said secondary winding which is applied to the electrodes of said spark plug for maintaining said arc.

* * * * *